US005598686A

United States Patent [19]

Owen

[11] Patent Number: 5,598,686

[45] Date of Patent: Feb. 4, 1997

[54] MAIL PROCESSING EQUIPMENT

[75] Inventor: Trevor W. Owen, Mississauga, Canada

[73] Assignee: Owen Tri-Cut Limited, Mississauga, Canada

[21] Appl. No.: 557,868

[22] Filed: Nov. 13, 1995

[51] Int. Cl.[6] ..... B65B 43/40

[52] U.S. Cl. ..... 53/492; 53/381.6; 53/386.1

[58] Field of Search ..... 53/492, 381.3, 53/386.1, 381.5, 381.6, 284.3

[56] References Cited

U.S. PATENT DOCUMENTS

| | | | |
|---|---|---|---|
| 3,726,454 | 4/1973 | Robbins | 53/381.6 |
| 4,295,321 | 10/1981 | Dehart et al. | 53/381.6 |
| 4,376,363 | 3/1983 | Russell | 53/381.6 |
| 4,866,908 | 9/1989 | Künne et al. | 53/381.6 |
| 5,134,834 | 8/1992 | Hayduchok | 53/381.6 |

*Primary Examiner*—John Sipos
*Assistant Examiner*—John Paradiso
*Attorney, Agent, or Firm*—Bereskin & Parr

[57] ABSTRACT

A method and apparatus for exposing the contents of envelopes for removal in which a horizontal stack of envelopes is advanced towards the suction roller. The envelopes have previously been opened along a top longitudinal edge and two vertical side edges. As each envelope reaches the suction roller, it is caused to adhere to the roller by suction. The roller is subsequently rotated through approximately 90° so that the leading panel of the envelope is "peeled" away from the contents and the envelope is lifted partially from the stack, permitting the contents to be withdrawn. The roller is subsequently turned in the opposite direction to eject the empty envelope downwardly.

12 Claims, 5 Drawing Sheets

MAIL PROCESSING EQUIPMENT

FIELD OF THE INVENTION

This invention relates generally to mail processing equipment and is concerned more particularly with a method and apparatus for extracting the contents of envelopes.

BACKGROUND OF THE INVENTION

Organizations such as credit card companies, utilities and the like, are faced with the problem of efficiently processing large volumes of incoming mail that they receive. For example, in a single business day, a utility or credit card company may receive tens of thousands of envelopes, many of which will each contain a remittance advice and a cheque in payment of a customer's account. Other correspondence and so-called "junk" mail will of course also be received. Accordingly, provision must be made to efficiently open all of the envelopes, check and verify the contents of those envelopes, and deal with the contents in an appropriate fashion. From a financial viewpoint, cheques and other remittances should be identified, verified and passed on within the organization, so that the payment can be credited through the banking system as quickly as possible. Delays in processing remittances can lead to substantial losses in terms of bank interest that would otherwise be generated.

Various attempts have been made to automate the mail handling process. For example, applicant's own U.S. Pat. No. 3,301,116 issued Jan. 31, 1967 discloses a mail processor which is commercially available under the trade mark TRI-CUT. Incoming envelopes are delivered to the TRI-CUT machine in stacks and the machine individually transports successive envelopes from the stack and opens each envelope along one longitudinal edge (the top edge) and each of the two side edges, leaving front and rear panels of the envelope joined along the other longitudinal edge. The two panels can then be readily separated and the contents extracted.

U.S. Pat. Nos. 4,625,497 and 5,131,545 issued respectively on Dec. 2, 1986 and Jul. 21, 1992 disclose machines for automatically extracting the contents of envelopes. While these machines have been found to satisfactorily and efficiently extract the contents of envelopes, the envelopes are handled in batches and the contents are collected in batches; as such, the contents must then be further processed individually in order to verify and appropriately deal each item. Also, it is occasionally necessary to identify the envelope from which a particular set of contents was extracted, and this can be difficult with a batch-type operation.

Accordingly, an object of the present invention is to provide a method and apparatus in which the envelopes can be handled individually and which makes provision for the contents of each envelope to be extracted, verified at least on a preliminary basis, and passed on for further processing.

SUMMARY OF THE INVENTION

In one aspect, the invention provides a method for extracting contents from envelopes which involves an initial step of providing a horizontal stack of envelopes in which the envelopes are generally vertically disposed, and in which each envelope has previously been opened along a longitudinal edge at the top of the stack and each of two generally vertical side edges, leaving front and rear panels of the envelopes joined along a bottom edge. The stack is advanced in steps to present successive envelopes to a suction roller at an extraction station and the roller is mounted for turning movement about a generally horizontal axis generally parallel to the longitudinal edges of the envelopes. For each successive envelope, a leading one of the panels of the envelope (i.e. the panel nearest to the roller) is caused to adhere to the roller by suction. While the suction is maintained, the roller is turned through a pre-determined angular amount in a direction to lift the envelope with respect to a stack and draw the leading panel away from the contents of the envelope, exposing the contents. The contents are then removed and the roller is turned in the reverse direction and the empty envelope ejected.

It will be appreciated that the method of the invention has the advantage that successive envelopes are individually raised and presented to an operator with the leading panel of the envelope "peeled" away from the contents, making it easy for the contents to be removed. Typically, the stack of envelopes will be advanced towards the operator and the operator will manually retrieve the contents of successive envelopes, make whatever verification is necessary, and then place the contents in an appropriate location for further handling. Each empty envelope is then ejected downwardly, for example, into a bin or other receptacle.

It will be understood that envelopes to be processed in accordance with the method of the invention will have been pre-opened along three edges. This can conveniently be accomplished using a TRI-CUT mail processor of the form disclosed in U.S. Pat. No. 3,301,116 supra. However, it is not essential to use a TRI-CUT processor for this operation.

According to another aspect of the invention there is provided an apparatus for extracting contents from envelopes which have previously been opened along a first longitudinal edge and at least two generally vertical side edges, leaving front and rear panels of the envelopes joined along a second longitudinal edge. The apparatus includes means for supporting a stack of said envelopes with the envelopes generally vertically disposed and the open longitudinal edges at the top. Means is provided for advancing the stack in steps to present successive envelopes to an extraction station. A suction roller at the extraction station is mounted for turning movement about a generally horizontal axis parallel to the longitudinal edges of the envelopes and includes suction means for causing a leading one of the panels of an envelope at said station to adhere to the roller by suction. Means is provided for turning the roller while maintaining the suction, through a pre-determined angular amount and in a first direction to lift the envelope with respect to the stack and draw the said leading panel away from the contents of the envelope, exposing the contents. The roller can also be turned in a second, opposite direction to eject the empty envelope after the contents have been removed.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
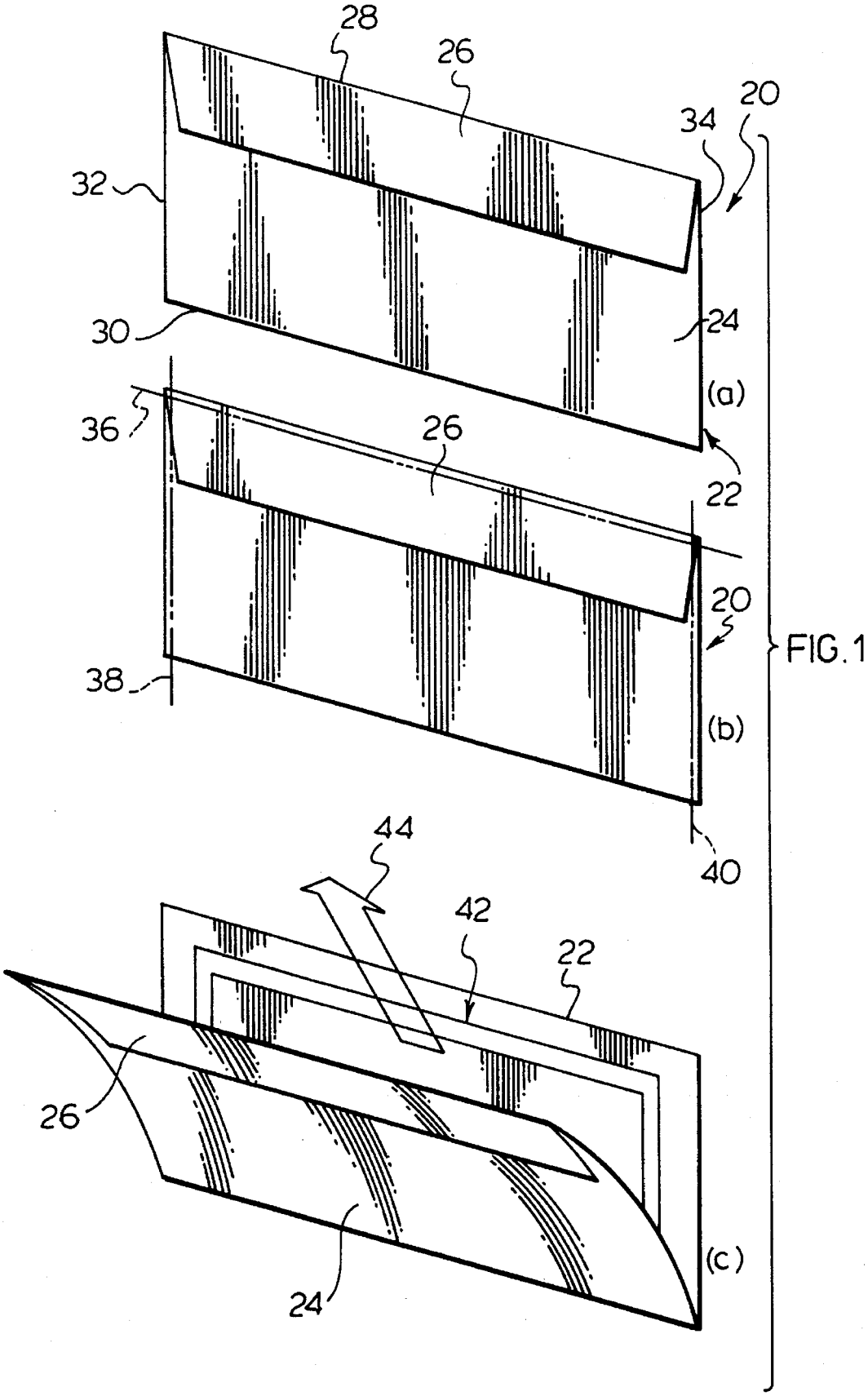
FIG. 1 comprises three views denoted (a), (b), and (c) showing, respectively, a complete envelope (with contents), the same envelope, but with cut lines for removing the top longitudinal edge and both side edges of the envelope, and (3) the rear panel of the envelope "peeled" back for removal of the contents of the envelope (indicated by the arrow)

Referring first to FIG. 1, a conventional envelope is generally indicated at 20 and has a front panel 22, a rear panel 24 and a sealing flap 26. Flap 26 is initially attached to front panel 22 at a top longitudinal edge 28, and is sealed to the back panel 24 when the envelope is closed. The front and back panels are joined at a bottom longitudinal edge 30 and at side edges 32 and 34.

As discussed previously, envelopes to be processed in accordance with the method of the invention are initially opened along the top edge 28 and along both side edges 32 and 34, for example by a mail processing machine of the form described in the '116 patent supra. In accordance with the patented invention, this is accomplished by cutting off thin marginal portions of the envelope along a top edge cut line 36, and respective side edge cut lines 38 and 40. This essentially opens the envelope along three sides, while leaving the front and rear panels connected along the fourth side (the bottom edge).

In FIG. 1 (*c*), the contents of the envelope are generally denoted by reference numeral 42 and may comprise, for example, a cheque and a remittance advice. In that view, the rear panel 24 is shown as having been "peeled" away from the front panel 22, exposing the contents 42 for removal, in accordance with the method of the invention (to be described).

Figure 2:
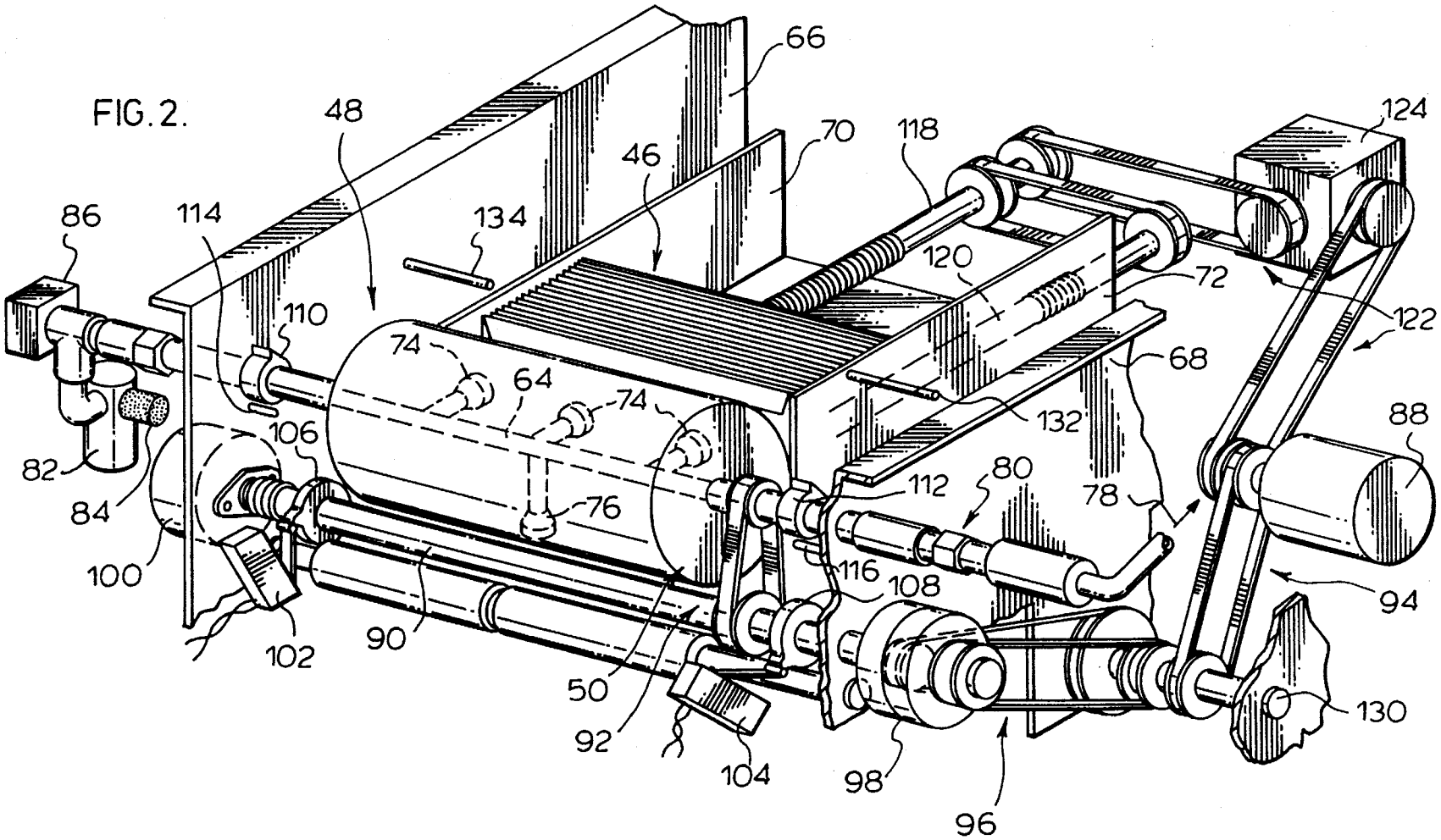
FIG. 2 is a front perspective view of an apparatus in accordance with the invention, with part of the associated structure removed.

Referring now to FIG. 2, a horizontal stack of envelopes is generally indicated at 46. The envelopes in the stack have been pre-opened as described with reference to FIG. 1 (*b*) and the envelopes are generally vertically disposed with their opened top edges uppermost. All of the envelopes are oriented with their rear panels 24 facing to the left as seen in FIG. 2. The stack of envelopes is disposed in advance of an extraction station generally denoted by reference numeral 48, which is defined by a suction roller 50.

As will be described in more detail later, the stack of envelopes is progressively advanced to present successive envelopes to the suction roller at the extraction station, as perhaps best illustrated in FIG. 3. Briefly, the leading panel (in this case the back panel 24) of an envelope that is at the extraction station is caused to adhere to the roller by suction. The roller is then advanced through approximately 90° to the position shown in FIG. 4 while maintaining the suction. This causes the panel to follow the surface of the roller, effectively "peeling" the panel away from the contents of the envelope and lifting the envelope with respect to the stack. The envelope is then generally shown in FIG. 1 (*c*). As can be seen, the contents 42 of the envelope are thereby exposed and can readily be extracted for removal and verification by an operator seated in front of roller 50 (to the left in FIGS. 3 to 6). Document detection means (not shown) may be provided to ensure that the envelope is empty.

Figure 4:
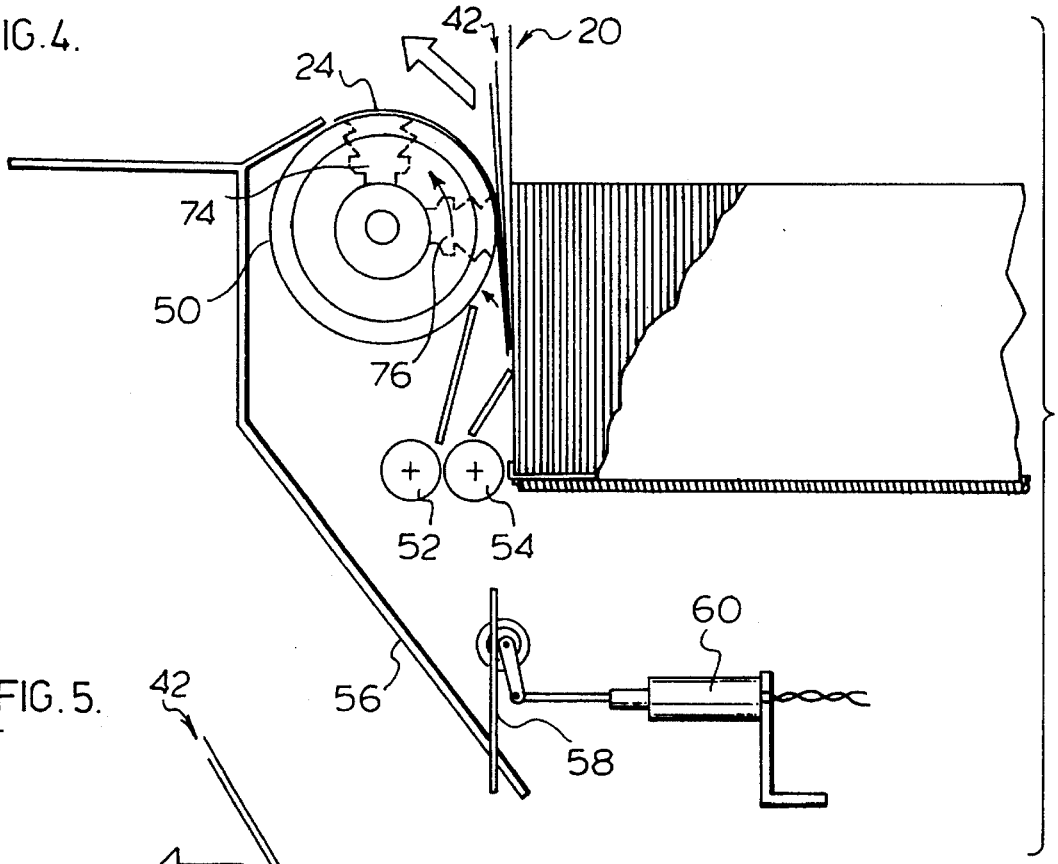
FIGS. 4, 5 and 6 are simplified views corresponding to FIG. 3 showing successive steps in the method of the invention.
Figure 5:
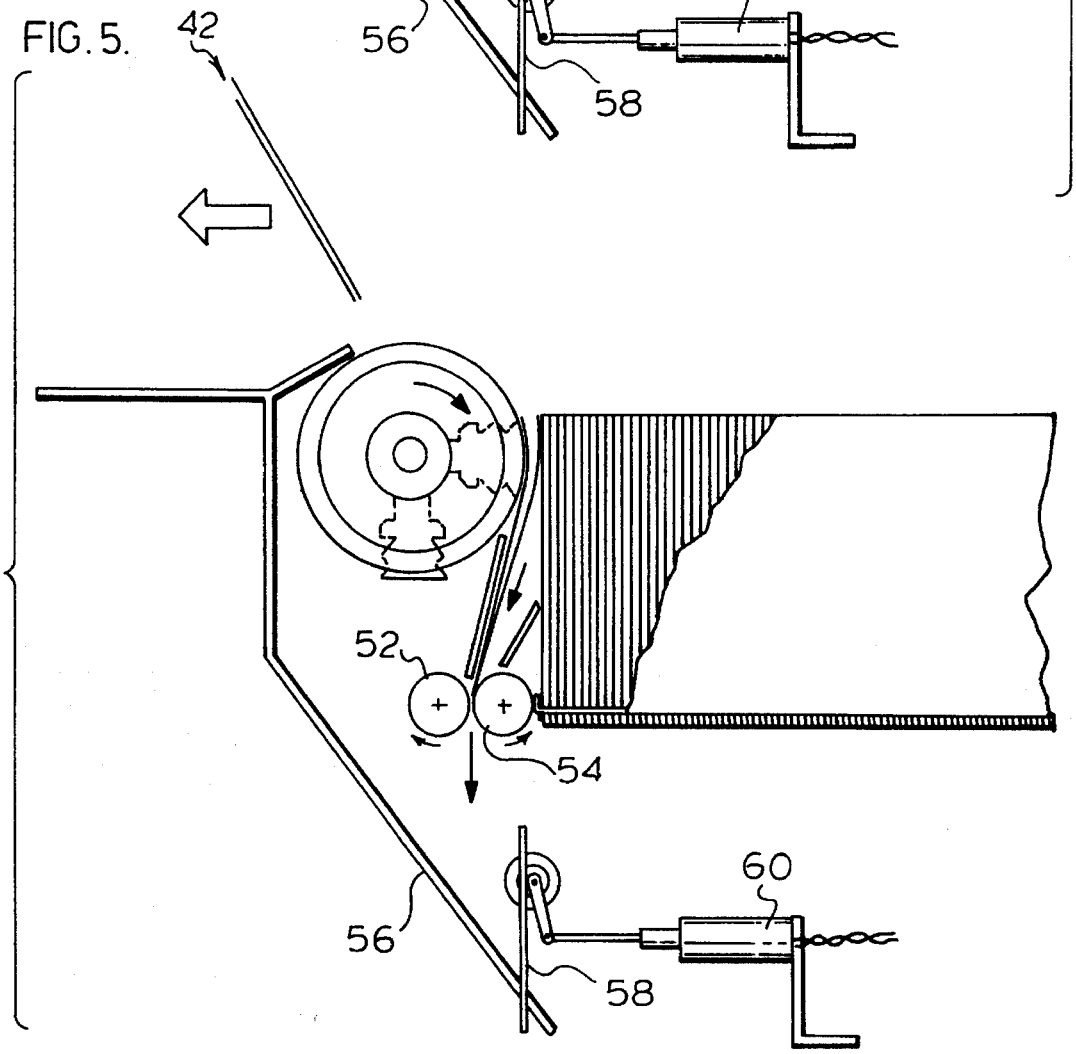
Figure 6:
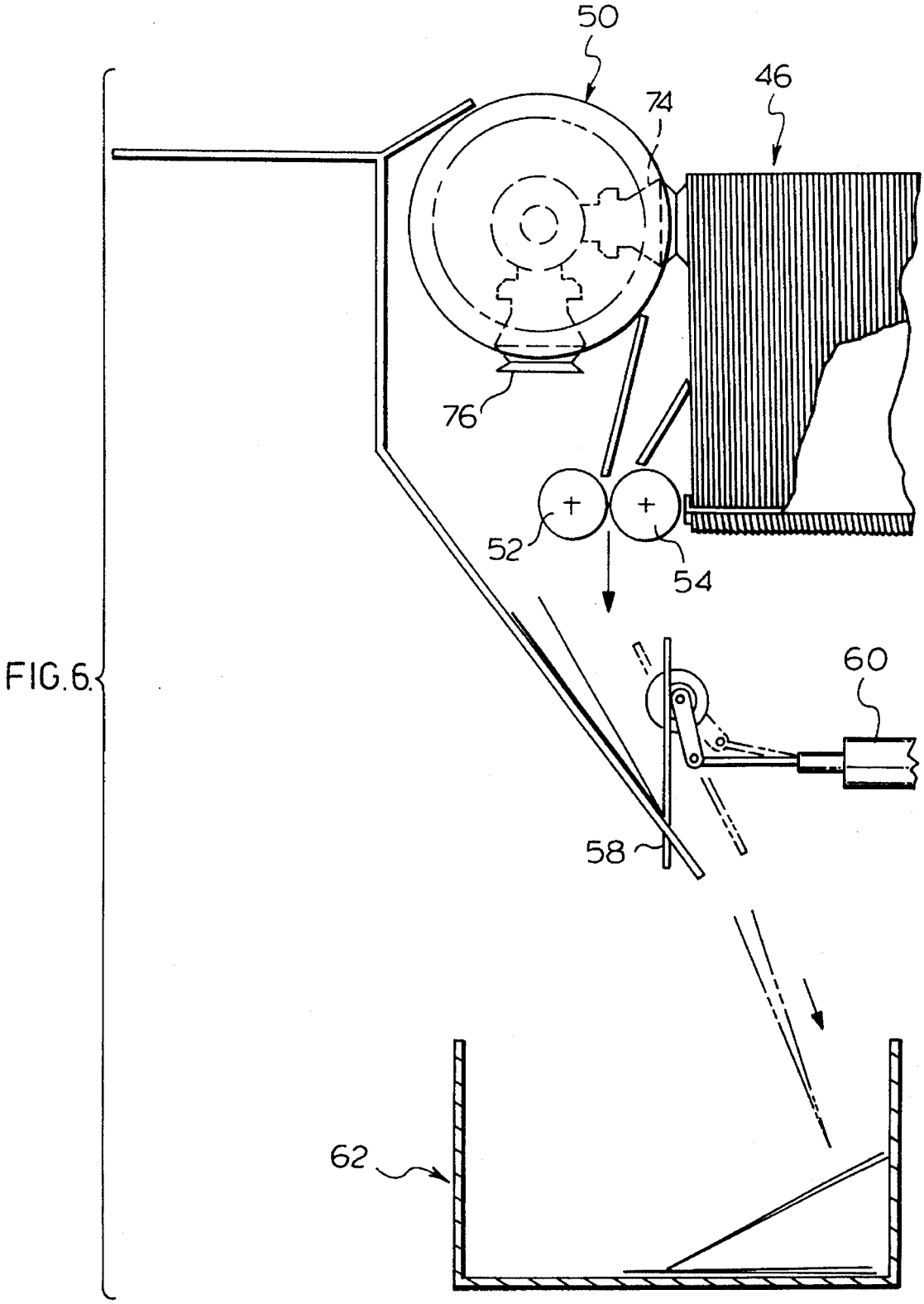

The roller is then reversed and the suction released so that the empty envelope is ejected downwardly and into the nip between a pair of pinch rollers 52 and 54 (FIG. 5) which deliver the envelope into a temporary holding "hopper" defined by a fixed chute 56 and a movable flap 58. Flap 58 is pivotally mounted so that it can be moved by a solenoid 60 between the closed position in which it is shown in FIGS. 4 and 5 and the open position which is shown in ghost outline in FIG. 6. This allows empty envelopes to be temporarily held in case it should be necessary to retrieve the envelope, for example, to identify the sender of a particular piece of mail. When the empty envelopes are released by the solenoid 60, they are discharged into a waste container 62 (FIG. 6).

Referring back to FIG. 2, roller 50 is mounted for turning movement about a generally horizontal axis which is generally parallel to the longitudinal edges of the envelopes, and which is defined by a shaft denoted 64. The roller itself has an axial length slightly greater than the length of the largest envelopes that are likely to have to be accommodated, and has a surface of polyurethane rubber for promoting good adhesion of the envelope panels to the roller under the effect of suction.

Shaft 64 is mounted to turn in a pair of bearings (not shown) carried by respective outer side panels 66 and 68. The stack of envelopes is disposed between inner side panels 70 and 72 and the panels are adjustable as to spacing for accommodating envelopes of different sizes. Vertical adjustment is also provided so that envelopes of different heights can be accommodated. Adjustment is provided for by simple screw-type mechanical adjusters; for convenience, and since they are essentially conventional, the adjusters have not been shown.

Suction for causing the envelopes to adhere to roller 50 is provided by a vacuum source (not shown), which communicates via a bore in shaft 64 with a series of vacuum ports at the surface of roller 50. In this particular embodiment, there are four vacuum ports. Considering the roller in the initial position shown in FIGS. 2 and 3, ready to engage a "fresh" envelope from stack 46, three of the ports are aligned generally parallel to shaft 64 in positions to correspond with the location of the flap 26 (FIG. 1) of each successive envelope that arrives at the extraction station, while the fourth port is positioned at a lower location for applying suction generally in the centre of the lower marginal portion of envelope back panel 24. It has been found that, by applying suction primarily in the area of the sealing flap 26 of the envelope, where there is in effect a double thickness of material because of the underlying portion of the back panel, the suction does not grip the contents 42 of the envelope under typical operating parameters for the apparatus. It has been found that, by applying the suction in these areas of the envelope, it is possible to "calibrate" the amount of suction so as to avoid carrying the contents with the back panel when the roller turns to draw the back panel around its surface.

Other envelope constructions may require a different arrangement of suction ports. Generally, at least near the top of the envelope, suction should be applied where there is a double thickness of paper, so as to avoid gripping the contents of the envelope. For example, suction may be applied to a side seam or to a diagonal seam.

In FIG. 2, the three suction ports are individually denoted by reference numeral 74 and the fourth port by numeral 76. The ports communicate with the bore in shaft 64 as shown, and the bore in turn communicates with a source of vacuum represented by the arrow denoted 78 in FIG. 2 by way of a rotary coupling 80. Each port is provided with a bellows-like rubber nipple, one of which is shown at **74*a*** in FIG. 3.

The vacuum source applies a constant suction to the ports 74 and 76 but the suction can be effectively interrupted by opening the suction line to atmosphere by means of a solenoid valve 82 at the end of shaft 64 opposite to coupling 80. An atmospheric air inlet valve 82 is indicated at 84. At the extreme end of the shaft is a vacuum switch 86 which prevents roller 50 turning until a pre-determined level of vacuum has been detected.

Drive for turning roller 50 is provided from a drive motor 88, via an intermediate drive shaft 90 disposed below and parallel to roller 50. A toothed belt drive between shaft 90 and roller shaft 64 is generally indicated at 92.

Shaft 90 is driven from motor 80 through intermediate belt drives 94 and 96, and a magnetic clutch 98. A brake 100 is provided at the end of shaft 90 opposite the magnetic clutch 98.

A pair of micro-switches 102 and 104 operated by corresponding cams 106 and 108 on shaft 90 control the angular movement of shaft 64 (and hence roller 50) via the magnetic clutch 98 and brake 100. When the clutch 98 releases so that drive is not longer transmitted to the roller via shaft 90, brake 100 is activated to hold the shaft (and hence roller 50) in a defined position to which it has been moved. In addition, a pair of profiled stops 110 and 112 on shaft 64 cooperate with respective fixed stops 114 and 116 to physically define the two angular positions of roller 50. The micro-switches 102 and 104 are angularly adjustable, as are the stops, for varying the angular amount through which roller 50 is turned.

Drive motor 88 also provides drive for progressively advancing the stack of envelopes towards the extraction station represented by roller 50. This is accomplished by a pair of screw-threaded shafts 118 and 120 that extend longitudinally below the stack of envelopes, in the direction in which the stack is to be advanced. The shafts are driven by a series of belts generally denoted 122 from motor 88 via a gear box 124. The bottom edges of the envelopes actually rest on the screw threads so that the envelopes are advanced directly by the threads as the shafts turn. This has the effect of also urging the envelopes in the same lateral direction and aligning them laterally against one of the side plates 70, 72 (depending on the direction of the screw rotation).

A micro-switch 125 (FIG. 3) at the front of the stack of envelopes interrupts the drive to the shafts 118 and 120 at gear box 124 as each successive envelope arrives at the extraction station and engages roller 50.

Figure 3:
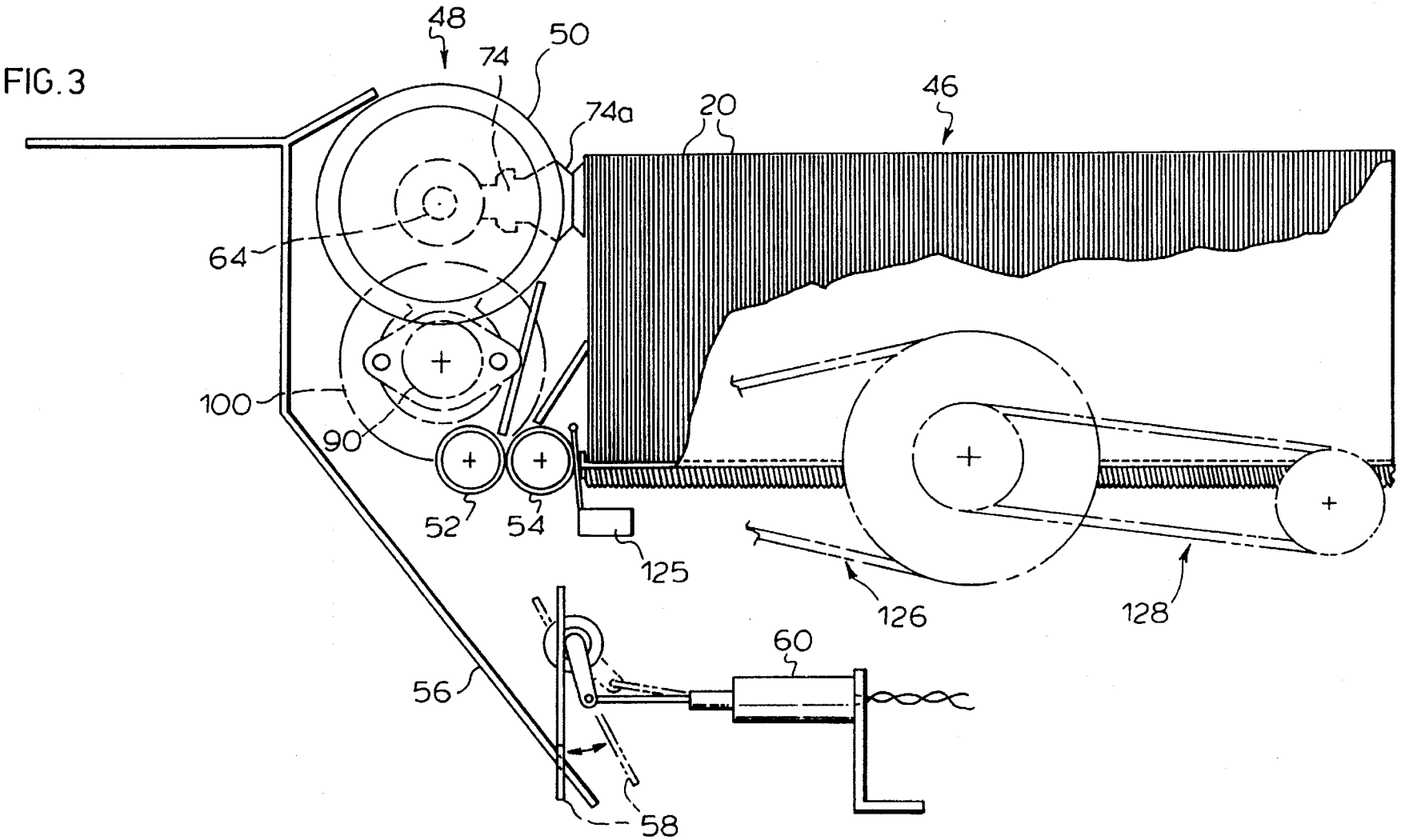
FIG. 3 is a general longitudinal sectional view corresponding to FIG. 2.

Belt drives indicated at 126 and 128 in FIG. 3 drive the pinch rollers 52 and 54 from an intermediate idler shaft 130 shown in FIG. 2.

Overall control of the apparatus is accomplished by a programmable logic controller (not shown) through which the various functions of the apparatus are integrated and controlled in appropriate timed fashion. A fibre-optic sender and receiver combination 132, 134 are provided immediately in advance of the extraction station to provide an appropriate signal for overall control of the apparatus.

It will of course be understood that the preceding description relates to a particular preferred embodiment of the invention only and that many modifications are possible within the broad scope of the invention. For example, while a suction roller which is a complete cylinder is preferred, a partial roller comprising a segment of a cylinder could be used. Also, while the surface of the roller preferably has a covering or coating of resilient material selected to promote adhesion of the envelopes to the roller, this is not essential.

I claim:

1. A method for exposing the contents of envelopes for removal, comprising the steps of:

providing a horizontal stack of envelopes in which the envelopes are generally vertically disposed, each envelope having previously been opened along a first longitudinal edge at the top of the stack and each of two generally vertical side edges, leaving front and rear panels of the envelopes joined along a second longitudinal edge;

progressively advancing the stack to present successive envelopes to a suction roller at an extraction station, the roller being mounted for turning movement about a generally horizontal axis generally parallel to the longitudinal edge of the envelopes; for each successive envelope:

(i) causing a leading one of said panels of the envelope to adhere to the roller by suction;

(ii) while maintaining said suction, turning the roller through a predetermined angular amount and in a first direction to lift the envelope in said first direction from the stack and draw the said panel away from the contents of the envelope, exposing the contents for removal; and, turning the roller in a second direction opposite to said first direction to move said envelope in said second direction, then terminating said suction, and ejecting the empty envelope.

2. A method as claimed in claim 1, wherein said predetermined angular amount through which the roller is turned in a first direction comprises approximately 90°.

3. A method as claimed in claim 1, wherein each said envelope includes at least one area in which there is a double thickness of envelope material, and wherein the method comprises the further steps of arranging the envelopes in said stack so that the envelopes are advanced towards the suction roller with said double-thickness areas facing said roller, and wherein said step of causing a leading one of said panels to adhere to the roller by suction is performed by applying suction to said area.

4. A method as claimed in claim 1, wherein empty envelopes ejected after turning the roller in said second direction are delivered into the nip between a pair of rollers mounted below the suction roller which positively withdraw the envelope from the suction roller.

5. A method as claimed in claim 1, wherein empty envelopes are ejected into a hopper below said roller, temporarily retained in said hopper, and then released after an appropriate time interval.

6. An apparatus for exposing the contents of envelopes which have previously been opened along a first longitudinal edge and at least two generally vertical side edges, leaving front and rear panels of the envelopes joined along a second longitudinal edge, the apparatus comprising:

means for supporting a horizontal stack of said envelopes with the envelopes generally vertically disposed and the open longitudinal edges at the top;

means for progressively advancing the stack to present successive envelopes to an extraction station;

a suction roller at said extraction station mounted for turning movement about a generally horizontal axis generally parallel to the longitudinal edges of the envelopes, the roller including suction means for causing a leading one of said panels of an envelope at said extraction station to adhere to the roller by suction;

means for turning the roller while maintaining said suction through a pre-determined angular amount and in a first direction to lift the envelope with respect to the stack and draw the said leading panel away from the contents of the envelope, exposing the contents for removal, said turning means being adapted to subsequently turn the roller in a second direction opposite to said first direction for ejecting the empty envelope.

7. An apparatus as claimed in claim 6, for use with said envelopes which further include a sealing flap on said rear panel of each envelope opposed adjacent said open longitudinal edge, the envelopes being intended to be supported in said stack with said sealing flaps facing said suction roller, and wherein said suction means includes a series of ports spaced axially of the suction roller for engaging the sealing flap of successive envelopes at a series of correspondingly spaced positions along said flap.

8. An apparatus as claimed in claim 7, wherein said suction means further comprises an additional port spaced below said series of ports for engaging a lower region of said rear panel of each envelope.

9. An apparatus as claimed in claim 7, wherein said roller includes a shaft defining said horizontal axis and provided with a bore communicating with said ports, and wherein said suction means further includes a suction source and rotary means coupling said source with said bore at an end region of said shaft.

10. An apparatus as claimed in claim 9, further comprising valve means at an opposite end region of said shaft operable to open said bore to atmosphere for terminating suction at said ports.

11. An apparatus as claimed in claim 10, further comprising, in association with said valve means, means for preventing said turning of the roller until the pre-determined level of suction is detected in said bore.

12. An apparatus as claimed in claim 7, wherein said roller is cylindrical and has an external surface of resilient material selected to promote adhesion of said envelopes to the roller.

* * * * *